US006795671B2

(12) United States Patent
Matsuoka

(10) Patent No.: US 6,795,671 B2
(45) Date of Patent: Sep. 21, 2004

(54) IMAGE FORMING APPARATUS FEATURING SWITCHABLE, CONTACT AND SPACED, CLUTCH-OPERATED DEVELOPING UNITS

(75) Inventor: Isao Matsuoka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/340,646

(22) Filed: Jan. 13, 2003

(65) Prior Publication Data

US 2003/0138270 A1 Jul. 24, 2003

(30) Foreign Application Priority Data

Jan. 15, 2002 (JP) ..... 2002/005682
Jan. 18, 2002 (JP) ..... 2002/010834

(51) Int. Cl.[7] ..... G03G 15/01; G03G 15/08
(52) U.S. Cl. ..... 399/223; 399/228
(58) Field of Search ..... 399/167, 228, 399/298, 299, 223

(56) References Cited

U.S. PATENT DOCUMENTS 6,546,218 B2 * 4/2003 Uchida ..... 399/167

FOREIGN PATENT DOCUMENTS

| | | |
|---|---|---|
| JP | 2-61662 | 3/1990 |
| JP | 2001-318506 | 11/2001 |

* cited by examiner

*Primary Examiner*—William J. Royer
(74) *Attorney, Agent, or Firm*—Fitzpatrick, Cella, Harper & Scinto

(57) ABSTRACT

An image forming apparatus includes a plurality of image forming portions, and a first switching device and a second switching device that act on a plurality of clutch devices. The second switching device communicates with the first switching device and operates in association with an operation of the first switching device. This makes it possible to simplify the construction of the image forming apparatus and to suppress reduction of the service life of an image bearing member.

8 Claims, 12 Drawing Sheets

IMAGE FORMING APPARATUS FEATURING SWITCHABLE, CONTACT AND SPACED, CLUTCH-OPERATED DEVELOPING UNITS

BACKGROUND OF THE INVENTION

1. Field of the Invention

The present invention relates to an image forming apparatus, such as a copying machine and a printer, that uses an electrophotographic system, and in particular to an image forming apparatus that is capable of forming a color image using a plurality of image bearing members and developing means that develop latent images formed on the image bearing members while contacting the image bearing members.

2. Related Background Art

As a conventional image forming apparatus that uses an electrophotographic process, there is a color image forming apparatus that adopts an in-line system (tandem system) in which a plurality of image forming portions are arranged in parallel and images are successively transferred onto a transferring material or the like on a transferring belt (intermediate transferring belt) or a transferring belt (transferring material transport belt) that is disposed so as to oppose the plurality of image forming portions. Here, each image forming portion includes an electrophotographic photosensitive member (photosensitive member) that is, for instance, a photosensitive drum. The image forming portion also includes process means, such as charging means, developing means, and cleaning means, that act on the photosensitive member.

As such a color image forming apparatus of the in-line system, there is a color image forming apparatus that has a construction where photosensitive members and process means, such as developing means, in respective image forming portions are integrally formed into process cartridges and these process cartridges are detachably attached to an image forming apparatus main body in a row. In accordance with this process cartridge system, when developer runs out, for instance, a user replaces the process cartridges by himself/herself without relying on a serviceman, thereby returning the image forming apparatus to a state where image formation is possible. At the same time, it is possible for the user to replace other consumable items such as the photosensitive members. Therefore, maintainability is greatly improved.

As developing means of each process cartridge applied to such an in-line type color image forming apparatus, there are generally known two systems that are a contact developing system, in which development is performed under a state where a developing roller is brought into contact with a photosensitive member, and a non-contact developing system in which development is performed under a state where a predetermined gap is formed between a developing roller and a photosensitive member. In the case of the contact developing system, however, there is a danger that there occur troubles given below.

(1) When photosensitive members rotate at a timing other than a developing operation (timing at which pre-rotation or post-rotation is performed, for instance), the surface layers of the photosensitive members are shaved due to rubbing with developing rollers, which becomes a factor of reduction of the service life thereof.

(2) At the time of mono-color development or the like, if cartridges for other colors that do not contribute to the development are also allowed to operate, the service life of their photosensitive members is greatly reduced.

(3) In the case where no bias is applied at the time of non-operation or during pre-rotation or post-rotation, developer on developing rollers adheres to photosensitive members, which becomes a factor of waste of the developer or stain on paper or the like due to the developer.

(4) In the case where an image forming apparatus remains unused for a long time under a state where process cartridges are attached to the main body of the image forming apparatus, the roller layers of developing rollers are permanently deformed, which becomes a factor of the occurrence of unevenness on an image at the time of development.

In order to solve the problems described above, there have been adopted various constructions. For instance, both of photosensitive drums and developing rollers for colors that do not contribute to image formation are retracted from a transferring belt and the driving of the photosensitive members and the developing rollers is stopped. Alternatively, a transferring belt is brought into contact with each photosensitive member for a required color by changing the traveling path of the transferring belt, and the driving of each photosensitive member and developing roller that do not contribute to image formation is stopped.

In the case of the conventional techniques described above, however, there is a disadvantage that a construction becomes complicated or there occurs a trouble due to the movement of the positions of photosensitive drums or the traveling path of a transferring belt that are important to the accuracy of image formation.

SUMMARY OF THE INVENTION

The present invention has been made in the light of the problems described above and an object of the present invention is to provide an image forming apparatus that is capable of suppressing reduction of the service life of an image bearing member.

Another object of the present invention is to provide an image forming apparatus that is capable of suppressing reduction of the service life of a developing roller.

Still another object of the present invention is to provide an image forming apparatus that facilitates switching between a full-color image forming state and a mono-color image forming state using a simple structure.

Still another object of the present invention is to provide an image forming apparatus including:

a plurality of image forming portions, each image forming portion including an image bearing member, developing means that is capable of contacting and being spaced from the image bearing member and supplies developer to the image bearing member, a motor that drives the developing means, and clutch means that is provided between the motor and the developing means;

a first switching means that acts on the plurality of clutch means; and a second switching means for having the developing means contact and spaced from the image bearing member, the second switching means communicating with the first switching means and operating in association with an operation of the first switching means.

Still another object of the present invention is to provide an image forming apparatus including:

a first image forming portion for forming a black image, the first image forming portion including a first image bearing member and a first developing means that is capable of contacting and being spaced from the first image bearing member and supplies developer to the first image bearing member;

second image forming portions for forming images in colors other than black, each of the second image forming portions including a second image bearing member and a second developing means that is capable of contacting and being spaced from the second image bearing member and supplies developer to the second image bearing member; and switching means for switching contact/space operations of the first developing means and the second developing means, the switching means being capable of moving the first developing means and the second developing means to a full-color image forming state in which the first developing means and the second developing means are respectively abutted against the first image bearing member and the second image bearing members, a mono-color image forming state in which only the first developing means is abutted against the first image bearing member, and a standby state in which all of the developing means are spaced from the image bearing members.

Still another object of the present invention is to provide a clutch applied to an image forming apparatus, including:

a gear portion that receives a power from a motor;

a drive side engagement component that receives the power transmitted to the gear portion; and a driven side engagement component that receives the power from the drive side engagement component, the drive side engagement component and the driven side engagement component being capable of contacting and being spaced from each other, in which the gear portion and engagement positions of the drive side engagement component and the driven side engagement component exist within approximately the same plane.

Other objects of the present invention will become apparent by reading the following detailed description with reference to the accompanying drawings.

DETAILED DESCRIPTION OF THE PREFERRED EMBODIMENTS

Hereinafter, an image forming apparatus according to the present invention will be described in more detail with reference to the drawings.

(Overall Construction)

Figure 1:
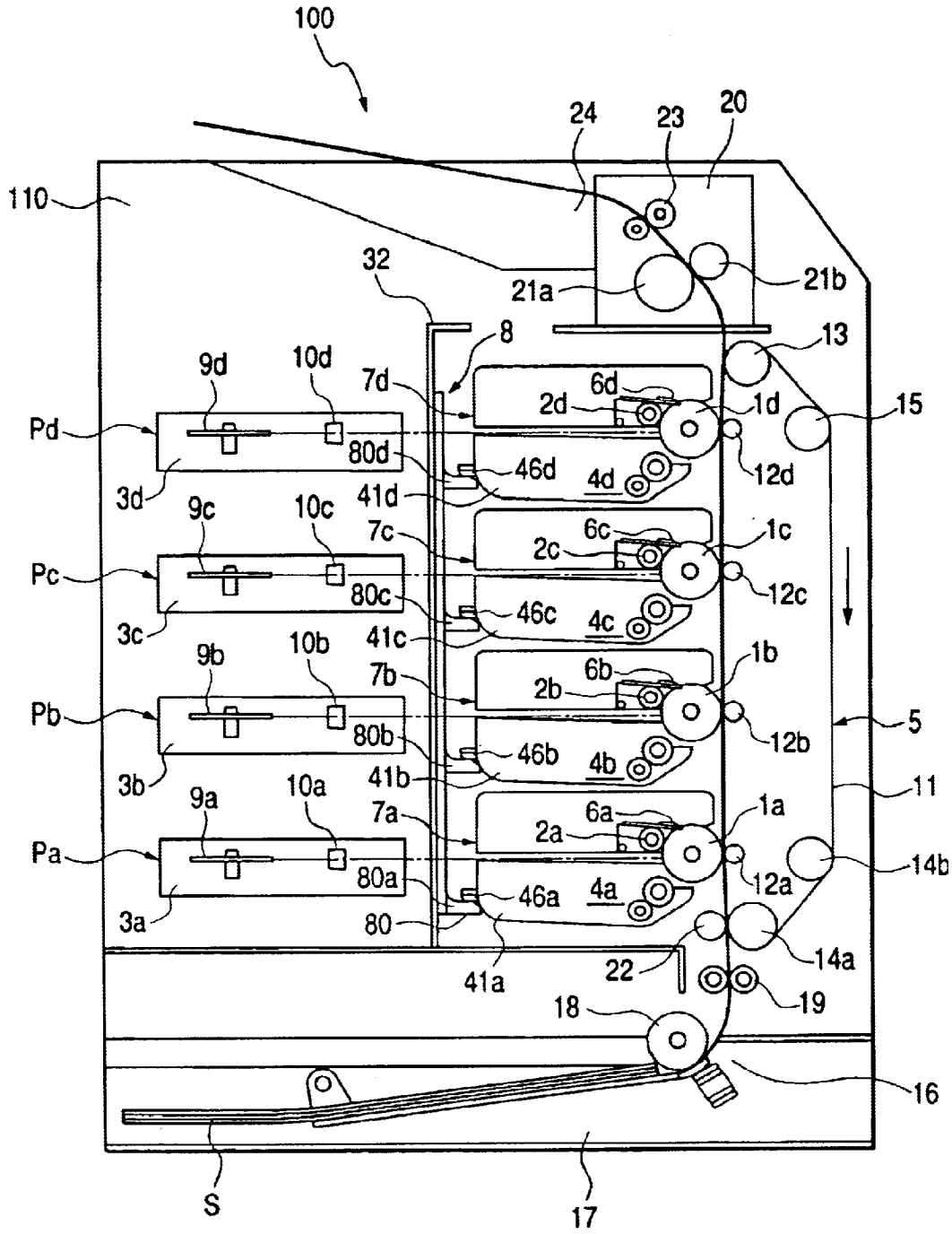
FIG. 1 is a cross-sectional view of an embodiment of an image forming apparatus according to the present invention, and shows a state (standby state) in which a developing roller is positioned downstream from a photosensitive drum in every process cartridge attached to an apparatus main assembly.

First, the overall construction of an image forming apparatus of this embodiment will be described with reference to FIG. 1. In this embodiment, the image forming apparatus is a full-color laser beam printer that is capable of forming a full-color image on a transferring material, such as a recording sheet or an OHP sheet, using an electrophotographic system in accordance with an image information signal from an external host apparatus, such as a personal computer, that is communicably connected to an apparatus main assembly. Note that the present invention is not limited to this and it is possible to implement the present invention in an arbitrary form such as a copying machine or a facsimile apparatus. FIG. 1 is a vertical cross-sectional view showing the overall construction of an image forming apparatus 100 of this embodiment.

The image forming apparatus 100 shown in FIG. 1 includes four drum-shaped electrophotographic photosensitive members that are disposed in parallel in an approximately vertical direction and function as image bearing members. That is, the image forming apparatus 100 includes photosensitive drums 1 (1*a*, 1*b*, 1*c*, and 1*d*). The photosensitive drums 1 are rotationally driven in a counterclockwise direction in FIG. 1 by drive means (to be described later) shown in FIG. 10. Around the photosensitive drums 1, charging apparatuses 2 (2*a*, 2*b*, 2*c*, and 2*d*) that uniformly charge the surfaces of the photosensitive drums 1, scanner units 3 (3*a*, 3*b*, 3*c*, and 3*d*) that form electrostatic latent images on the photosensitive drums 1 by irradiating laser beams on the basis of image information, developing apparatuses 4 (4*a*, 4*b*, 4*c*, and 4*d*) that develop the latent images as toner images by having toner contained in developer adhere to the electrostatic latent images, an electrostatic transferring apparatus 5 that transfers the toner images on the photosensitive drums 1 onto a transferring material S, cleaning apparatuses 6 (6*a*, 6*b*, 6*c*, and 6*d*) that remove transfer residual toner residing on the surfaces of the photosensitive drums 1 after the transfer, and the like are disposed in this order along the rotation direction of the photosensitive drums 1.

In this embodiment, images in colors that are different from each other (yellow, magenta, cyan, and black) are formed by four image forming portions Pa, Pb, Pc, and Pd that each include the photosensitive drum 1, the charging apparatus 2, the scanner unit 3, the developing apparatus 4, the cleaning apparatus 6, and the like and function as image forming means.

Figure 2:
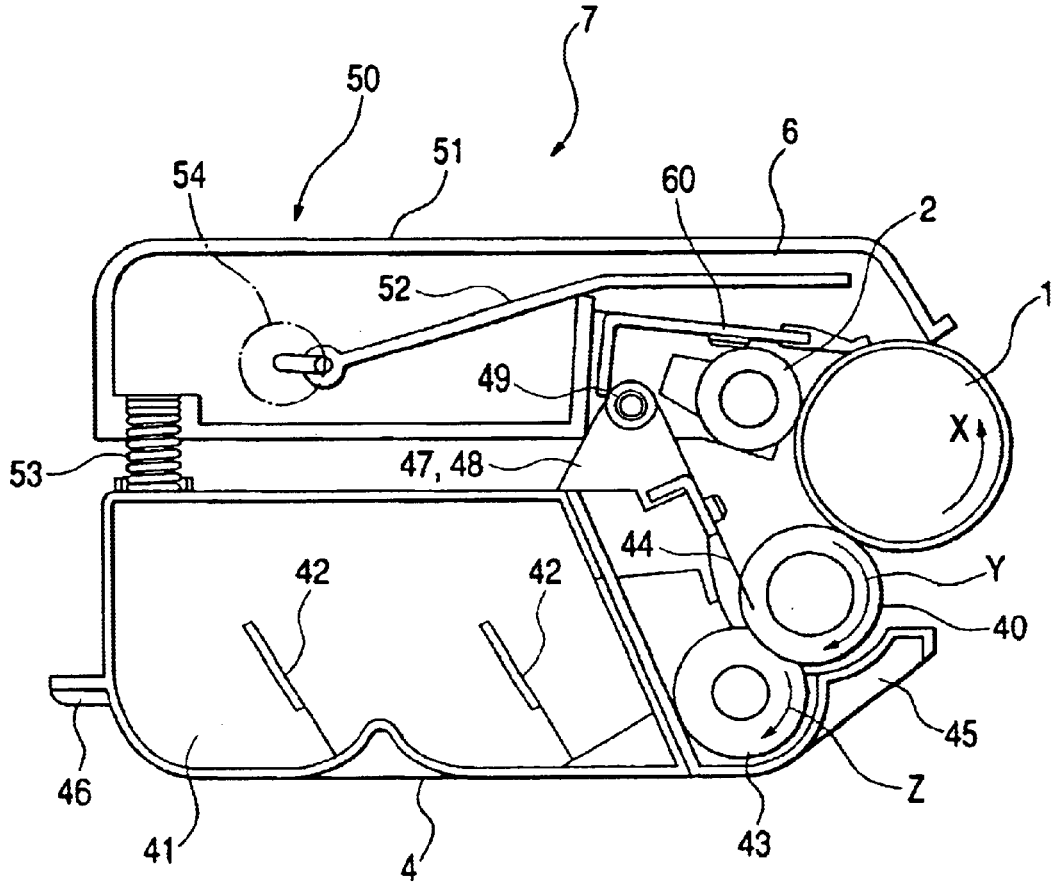
FIG. 2 is a cross-sectional view of the process cartridge to be attached to the image forming apparatus of FIG. 1.

The photosensitive drums 1 and process means, such as the charging apparatuses 2, the developing apparatuses 4, and the cleaning apparatuses 6, that act on the photosensitive drums 1 are integrally formed into cartridges, thereby forming process cartridges 7 (7*a*, 7*b*, 7*c*, and 7*d*) that are detachably attachable to an apparatus main assembly 110. FIG. 2 is a vertical cross-sectional view of one of the process cartridges 7.

Here, in the following description, the front side of the image forming apparatus 100 refers to a side on which the process cartridges 7 are inserted into the apparatus main assembly 110, that is, the right side in FIG. 1. Also, the left and right sides of the image forming apparatus 100 refer to sides when viewed from the apparatus front side.

Hereinafter, respective elements will be described in more detail in due order from the photosensitive drums 1.

Each photosensitive drum 1 is constructed by applying an organic photoconductive body layer (OPC photosensitive member) onto the outer peripheral surface of, for instance, an aluminum cylinder having a diameter of 30 mm. The photosensitive drum 1 is supported by supporting members at both end portions so as to be freely rotated, and is rotationally driven in a counterclockwise direction in FIG. 1 through the transmission of a drive force from a drive motor (to be described later) to one of the end portions.

As each charging apparatus 2, it is possible to use a charging member of a contact charging system. The charging member is a conductive roller formed to have a roller shape, and the surface of the photosensitive drum 1 is uniformly charged by abutting this roller against the surface of the photosensitive drum 1 and applying a charging bias voltage to the roller.

Figure 4:
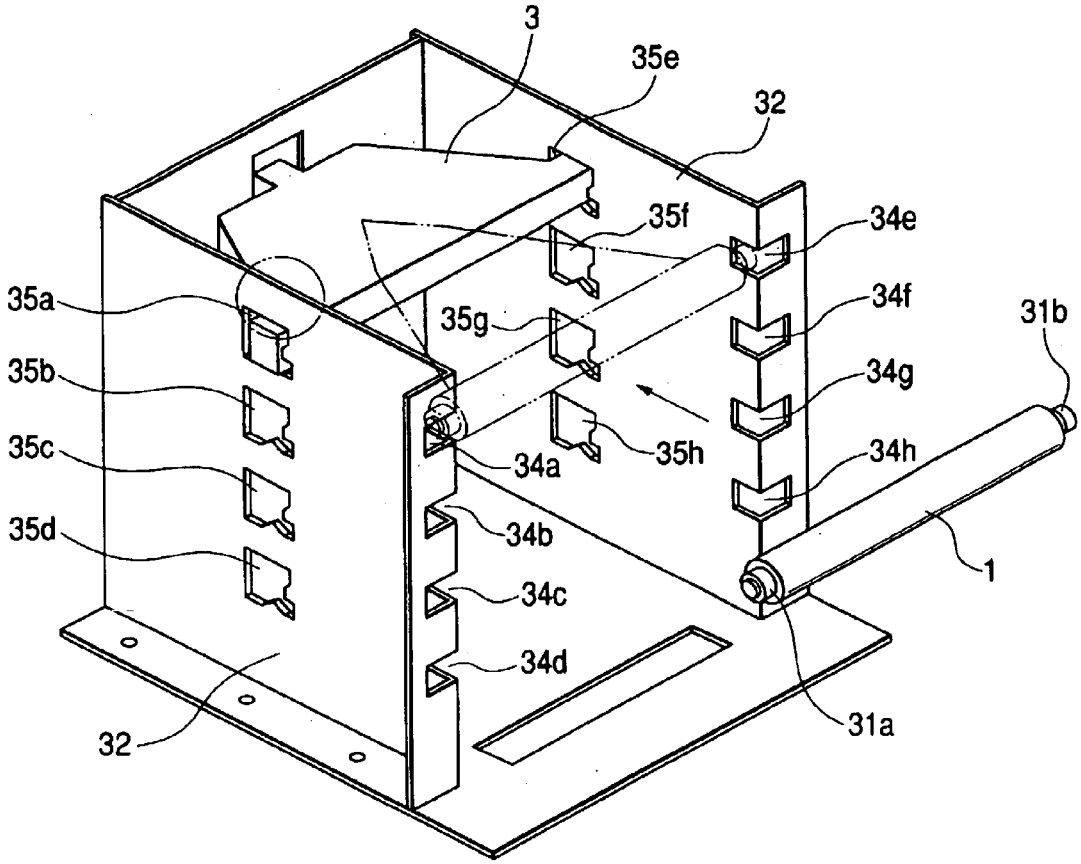
FIG. 4 is a perspective view showing the vicinity of a side board inside the apparatus main assembly for explaining an embodiment of a method of attaching the process cartridge to the image forming apparatus.
Figure 5:
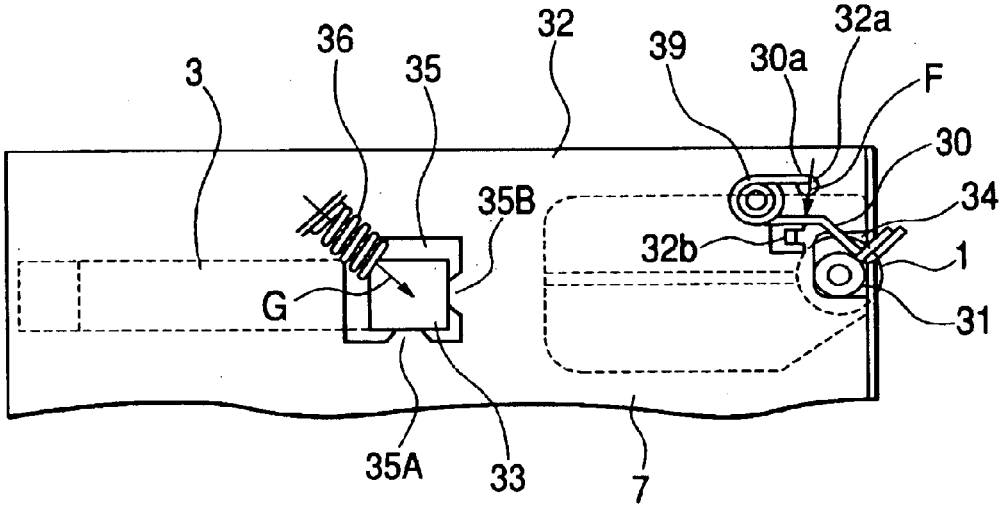
FIG. 5 is a partial cross-sectional view showing a portion for performing positioning of the process cartridge to the image forming apparatus.

Each scanner unit 3 is disposed in an substantially horizontal direction with reference to the photosensitive drum 1, and image light corresponding to an image signal is irradiated by a laser diode (not shown) onto a polygon mirror (9*a*, 9*b*, 9*c*, or 9*d*) that is rotated at high speed by a scanner motor (not shown). The image light reflected by the polygon mirror 9*a*, 9*b*, 9*c*, or 9*d* selectively exposes the surface of the charged photosensitive drum 1 through an imaging lens (10*a*, 10*b*, 10*c*, or 10*d*), thereby forming an electrostatic latent image. Also, as shown in FIGS. 4 and 5, the scanner unit 3 is formed so as to be longer than a pitch between left- and right-side boards 32 in a lengthwise direction and is attached so that protrusion portions 33 protrude to the outside from opening holes 35 (35*a*, 35*b*, 35*c*, 35*d*, 35*e*, 35*f*, 35*g*, and 35*h*) of the left- and right-side boards 32. When attached, the scanner unit 3 is pressed down by a compression spring 36 at an angle of around 45° with reference to the horizontal direction as indicated by arrow G in FIG. 5 with a force of around 1 kgf (almost equal to 9.8 N). As a result of this pressing, the scanner unit 3 is reliably pressed against bumping portions 35A and 35B and is positioned.

Each developing apparatus 4 includes a toner container 41 (41*a*, 41*b*, 41*c*, or 41*d*) that contains toner in one of colors that are yellow, magenta, cyan, and black as developer, and sends the toner in the toner container 41 to a toner supplying roller 43 using toner feeding mechanisms 42, as can be seen when FIG. 2 is also referred to. By the toner supplying roller 43 that rotates in a clockwise direction in FIG. 2 and a developing blade 44 that is brought into press-contact with the outer periphery of a developing roller 40, toner is applied to the outer periphery of the developing roller 40 that rotates in the clockwise direction in FIG. 2 and electric charges are given to the toner. Then, in usual cases, a developing bias, in which an AC voltage is superimposed on a DC voltage, is applied to the developing roller 40 that opposes the photosensitive drum 1 on which a latent image has been formed, thereby supplying the toner onto the photosensitive drum 1 in accordance with the latent image.

An electrostatic transferring belt (transferring belt) 11 that functions as transferring material transporting means and circularly moves is disposed so as to oppose and contact all of the photosensitive drums 1. The transferring belt 11 is constructed from a film-shaped member having a volume specific resistance of $10^{11}$ to $10^{14}$ Ω·cm and a thickness of around 150 μm. This transferring belt 11 is supported by rollers at four axes in a vertical direction and circularly moves in order to have the transferring material S electrostatically suctioned by the outer peripheral surface on the left side in FIG. 1 and have the transferring material S contact each photosensitive drum 1. Thus, the transferring material S is transported to transferring positions by the transferring belt 11 and the toner images on the photosensitive drums 1 are transferred onto the transferring material S.

Transferring rollers (12*a*, 12*b*, 12*c*, and 12) are disposed in parallel at positions (transferring positions) that are abutted against the inside of the transferring belt 11 and respectively oppose the four photosensitive drums 1. Electric charges having a positive polarity are applied to the transferring material S from these transferring rollers 12 through the transferring belt 11. By means of an electric field generated by these electric charges, toner images having a negative polarity and existing on the photosensitive drums 1 are transferred onto the transferring material S that is contacting the photosensitive drums 1. The transferring belt 11 constitutes an image transporting member that bears and transports the transferring material S onto which there will be transferred the toner image formed on each photosensitive drum 1.

In this embodiment, the transferring belt 11 is a belt having a peripheral length of around 700 mm and a thickness of 150 μm, is stretched by four rollers that are a drive roller 13, driven rollers 14*a* and 14*b*, and a tension roller 15, and rotates in the arrow direction in FIG. 1 through the rotational driving of the drive roller 13 by a drive motor (not shown) functioning as image transporting member drive means. While the transferring belt 11 is circularly moving and the transferring material S is being transported from the driven roller 14*a* side to the drive roller 13 side, the toner images are transferred onto this transferring material S.

A sheet feeding portion 16 feeds and transports the transferring material S to the image forming portion and a plurality of transferring materials S are contained in a feed cassette 17. At the time of image formation, a feed roller 18 (semilunar roller) and a registration roller pair 19 are rotationally driven in accordance with an image forming operation, the transferring materials S in the feed cassette 17 are separated and fed one by one, and the leading end of the transferring material S is bumped against the registration roller pair 19. At the registration roller pair 19, the transferring material S is temporarily stopped and forms a loop. Then, the transferring material S is fed to the transferring belt 11 by the registration roller pair 19 by synchronizing the rotation of the transferring belt 11 and an image writing start position.

A fixing portion 20 is a portion that fixes the toner images in a plurality of colors transferred onto the transferring material S, and is constructed from a heating roller 21*a* that rotates and a pressurizing roller 21*b* that is brought into press-contact with the heating roller 21*a* and gives heat and pressure to the transferring material S. That is, the transferring material S, onto which the toner images on the photosensitive drums 1 have been transferred, is transported by a pair of fixing rollers 21*a* and 21*b* and is given heat and pressure by the pair of fixing rollers 21*a* and 21*b* while passing through the fixing portion 20. As a result of this operation, the toner images in a plurality of colors are fixed on the surface of the transferring material S.

Next, how the image forming apparatus 100 having the construction described above operates will be described.

Each process cartridge 7 is successively driven in synchronization with an image forming timing and each photosensitive drum 1 is rotationally driven in the counterclockwise direction in FIG. 1 in accordance with the driving of the process cartridge 7. Then, the scanner units 3 corresponding to respective process cartridges 7 are successively driven. As a result of this driving, the charging rollers 2 give uniform electric charges to the peripheral surfaces of respective photosensitive drums 1 and the scanner units 3 expose the peripheral surfaces of the photosensitive drums 1 in accordance with an image signal, thereby forming electrostatic latent images on the peripheral surfaces of the photosensitive drums 1. The developing rollers 40 in the developing apparatuses 4 form toner images (perform development) on the peripheral surfaces of the photosensitive drums 1 by transferring toner to each low-potential portion of the electrostatic latent images.

At a timing at which the leading end of the toner image formed on the peripheral surface of the photosensitive drum 1 on the uppermost stream side is rotationally transported to a point (transferring position) opposing the transferring belt 11, the registration roller pair 19 starts its rotation and feeds the transferring material S to the transferring belt 11 so that the image forming start position of the transferring material S coincides with the opposing point.

The transferring material S is brought into press-contact with the outer periphery of the transferring belt 11 while being sandwiched between an electrostatic suction roller 22 and the transferring belt 11. Also, by applying a voltage between the transferring belt 11 and the electrostatic suction roller 22, electric charges are induced on the transferring material S that is a dielectric and the dielectric layer of the transferring belt 11, thereby having the transferring material S electrostatically suctioned by the outer periphery of the transferring belt 11. As a result of these operations, the transferring material S is suctioned by the transferring belt 11 with stability and is transported until the transferring position on the lowermost stream side.

As described above, while the transferring material S is being transported on the transferring belt 11, the toner images on respective photosensitive drums 1 are successively transferred onto the transferring material S by electric fields formed between respective photosensitive drums 1 and the transferring rollers 12*a*, 12*b*, 12*c*, and 12*d*.

The transferring material S, on which the toner images in four colors have been transferred, is curvature-separated from the transferring belt 11 by the curvature of the drive roller 13 and is transported to the fixing portion 20. After the toner images are thermally fixed on the transferring material S by the fixing portion 20, the transferring material S is delivered by a delivery roller pair 23 from a delivery portion 24 to the outside of the apparatus main assembly 110 under a state where an image surface faces down.

(Process Cartridge)

Figure 3:
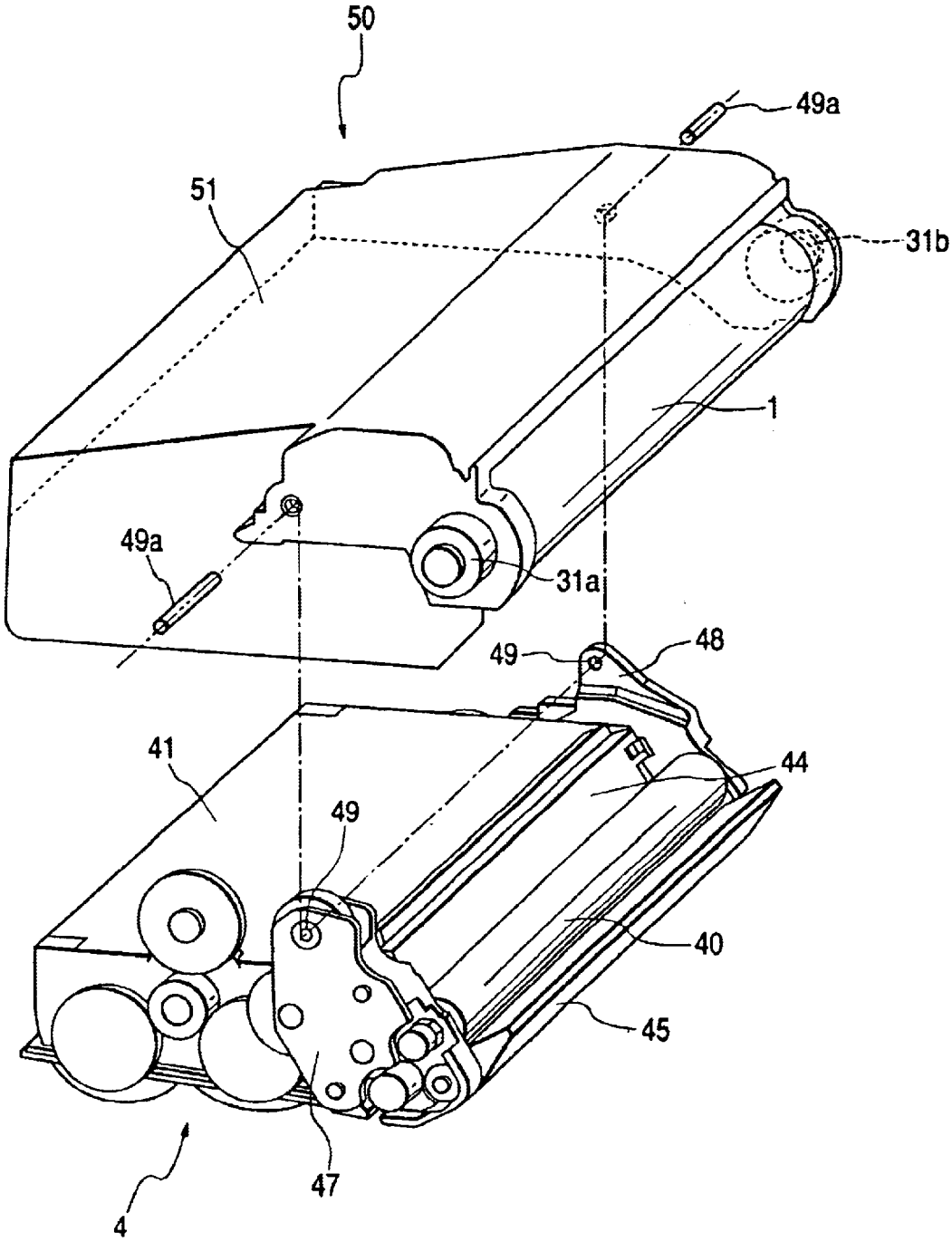
FIG. 3 is a disassembled perspective view of the process cartridge of FIG. 2.

Next, the process cartridges will be described in more detail with reference to FIGS. 2 and 3. FIGS. 2 and 3 are respectively a main cross-sectional view and a perspective view of one of the process cartridges 7. Note that respective process cartridges 7 (7*a*, 7*b*, 7*c*, and 7*d*) for yellow, magenta, cyan, and black have the same construction.

The process cartridge 7 is divided into a photosensitive drum unit 50 and a developing apparatus 4. The photosensitive drum unit 50 includes a drum-shaped electrophotographic photosensitive member functioning as an image bearing member, that is, the photosensitive drum 1, primary charging means (charging apparatus) 2, and the cleaning means (cleaning apparatus) 6. The developing apparatus 4 is constructed from the developing means (developing apparatus) that develops the electrostatic latent image on the photosensitive drum 1.

In the photosensitive drum unit 50, the photosensitive drum 1 is attached to a cleaning frame 51 through bearings 31 (31*a* and 31*b*) so as to be freely rotated. On the periphery of the photosensitive drum 1, there are disposed the charging apparatus 2 that uniformly charges the surface of the photosensitive drum 1 and a cleaning blade 60 of the cleaning apparatus 6 that removes toner residing on the photosensitive drum 1. Further, the residual toner removed from the surface of the photosensitive drum 1 by the cleaning blade 60 is successively sent to a waste toner chamber 54 provided at the rear of the cleaning frame 51 by a toner sending mechanism 52. Then, by transmitting a drive force of a drive motor (to be described later) functioning as drive means disposed in the apparatus main assembly 110 on one end side on the frontward side in FIG. 2 of the process cartridge 7, the photosensitive drum 1 is rotationally driven in the arrow X direction (counterclockwise direction) in FIG. 2 in accordance with an image forming operation.

The developing apparatus 4 includes the developing roller 40 that rotates in the arrow Y direction (clockwise direction) in FIG. 2 while contacting the photosensitive drum 1, the toner container 41 in which toner is contained, and a developing frame 45. The developing roller 40 is supported by the developing frame 45 through bearing members 47 and 48 so as to be freely rotated. Also, on the periphery of the developing roller 40, there are disposed the toner supplying roller 43 that contacts the developing roller 40 and rotates in the arrow Z direction (clockwise direction) in FIG. 2 and the developing blade 44 functioning as means for regulating the thickness of a developer layer on the developing roller 40. Further, in the toner container 41, there are provided the toner feeding mechanisms (developer agitating and feeding blades) 42 that agitate the contained toner and feed the agitated toner to the toner supplying roller 43. Also, the developing apparatus 4 has a hanging structure where the whole of the developing apparatus 4 is supported by pins 49*a* so as to be freely rocked with respect to the photosensitive drum unit 50 about a support axes 49 that are respectively provided for the bearing members 47 and 48 attached to both ends of the developing apparatus 4. Under a state where the process cartridge 7 is detached (state where the process cartridge 7 is not attached to the apparatus main assembly 110), the developing apparatus 4 is energized at all times by a pressurizing spring 53 so that the developing roller 40 contacts the photosensitive drum 1 through an angular moment about the support axes 49. Further, the toner container 41 of the developing apparatus 4 is integrally provided with a rib 46 that functions as an action receiving portion against which space/contact switching means 8 (to be described later) of the apparatus main assembly 110 will be abutted when the developing roller 40 should be spaced from the photosensitive drum 1.

(Drive Construction)

Next, an operation mechanism at the time of attachment of the process cartridge 7 to the apparatus main assembly 110 will be described in detail by also referring to FIGS. 4 to 10. Note that in FIG. 4, for ease of explanation of the construction of the present invention, only the photosensitive drum 1 and the bearings 31, out of the construction elements of the process cartridge 7, are illustrated. In reality, however, as has been described above, the process cartridge 7 is obtained by integrally constructing the charging apparatus 2, the developing apparatus 4, the cleaning apparatus 6, and the like (see FIG. 2).

Figure 6:
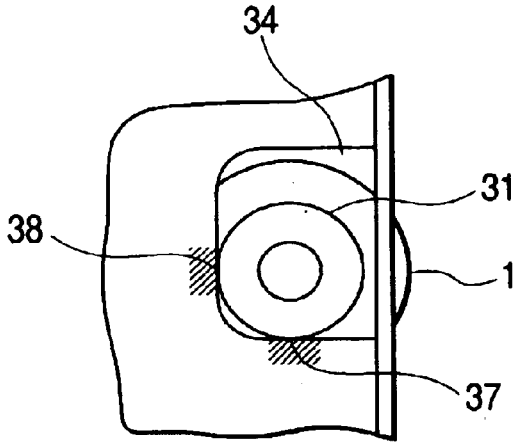
FIG. 6 is another partial cross-sectional view showing the portion for performing positioning of the process cartridge to the image forming apparatus.

As has been described above, under a detached state, the process cartridge 7 is placed in a state where the developing roller 40 contacts the photosensitive drum 1 at all times, as shown in FIG. 2. As shown in FIG. 4, the process cartridge 7 is attached to the apparatus main assembly 110 by inserting the bearings 31 supporting the photosensitive drum 1 in the arrow direction (from the apparatus frontward side) along guide grooves 34 (34*a*, 34*b*, 34*c*, 34*d*, 34*e*, 34*f*, 34*g*, 34*h*) provided for the left- and right-side boards 32. At this time, the transferring belt 11 is retracted along with, for instance, the door on the front side of the apparatus main assembly 110, thereby opening a portion into which the process cartridge 7 is to be inserted. Then, as shown in FIG. 6, the bearings 31 are pressed against bumping surfaces 37 and 38 of the guide grooves 34, thereby positioning the process cartridge 7.

The process cartridge 7 is pressed in the apparatus main assembly 110 with a method given below. As shown in FIG. 5, axes 39 are caulked to the left- and right-side boards 32, helical coil springs 30 are supported by the axes 39, and their end portions 30*a* are inserted into holes 32*a* of the left- and right-side boards 32 and are fixed therein. Under a state where the process cartridge 7 is not attached, the helical coil springs 30 are regulated in the rotation direction by bent and raised portions 32*b* from the left- and right-side boards 32. Then, when the process cartridge 7 is inserted, the helical coil springs 30 are rotated in the counterclockwise direction in FIG. 5 in defiance of their force. When having gotten over the bearings 31, the helical coil springs 30 are positioned as shown in FIG. 5 and press the bearings 31 against the bumping surfaces 37 and 38 of the guide grooves 34 in the arrow F direction with a force of around 1 kgf (almost equal to 9.8 N).

Figure 7:
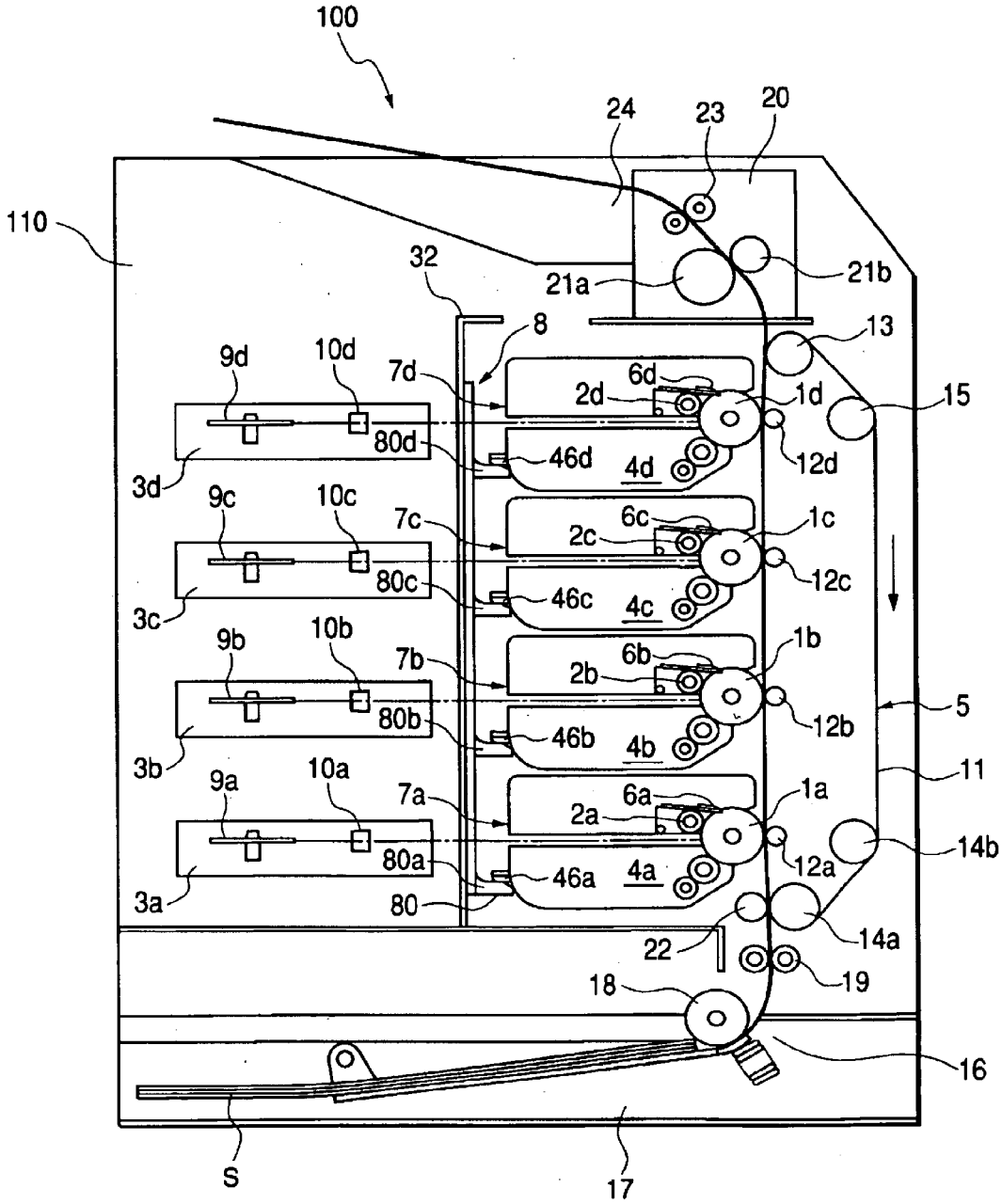
FIG. 7 is the same drawing as FIG. 1 and shows a state (full-color image forming state) in which the developing roller contacts the photosensitive drum in every process cartridge.
Figure 8:
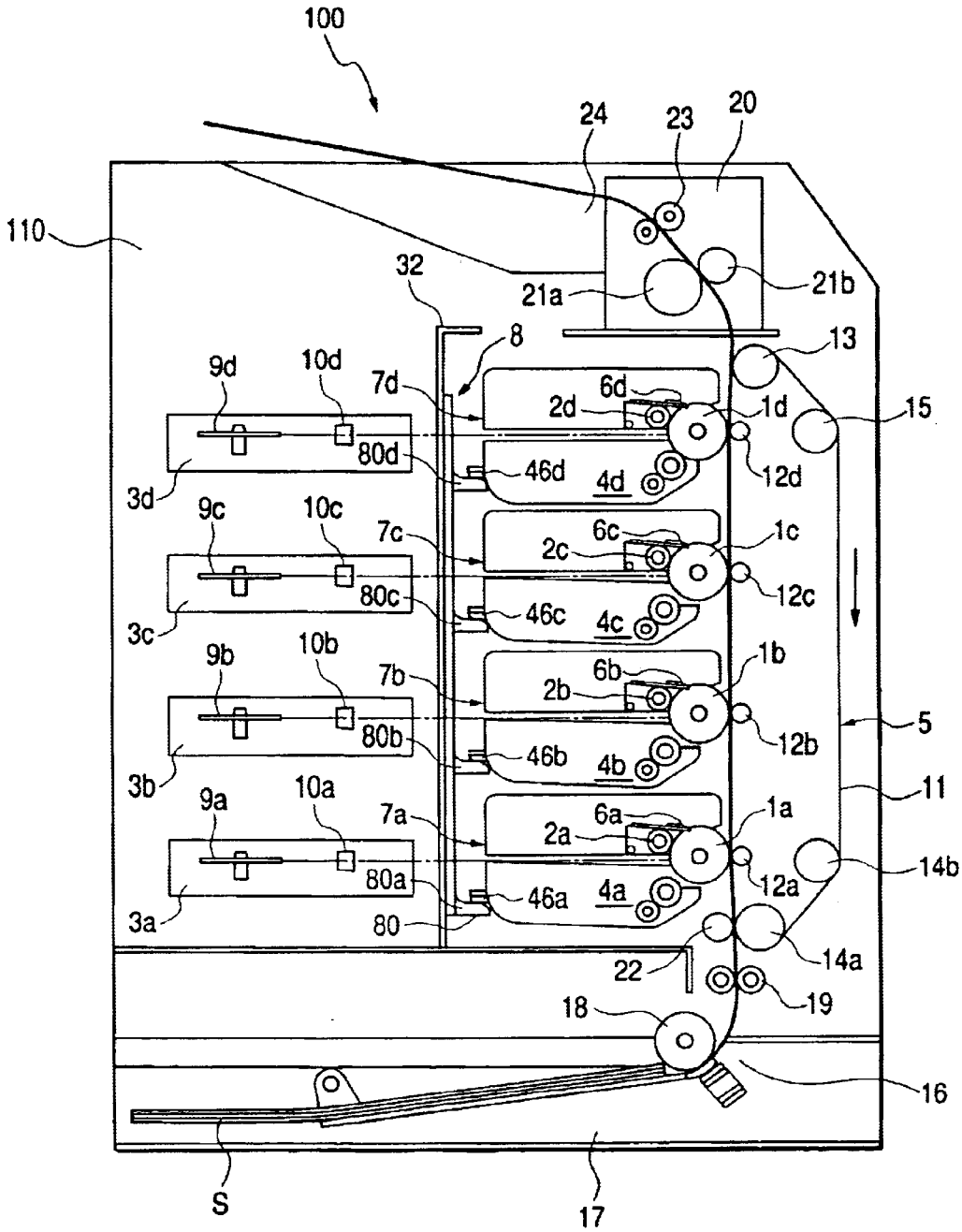
FIG. 8 is the same drawing as FIG. 1 and shows a state (mono-color image forming state) in which the developing roller contacts the photosensitive drum in the process cartridge for black and the developing roller is spaced from the photosensitive drum in each process cartridge for a color other than black.

At this time, on the back side of the apparatus main assembly 110 in the insertion direction of the process cartridges 7, as shown in FIGS. 1, 7, and 8, there is disposed space/contact switching means 8 for spacing the developing rollers 40 from the photosensitive drums 1 in defiance of the energizing force exerted on the developing apparatuses 4 by the pressurizing springs 53 (see FIG. 2).

The space/contact switching means 8 is provided with spacing boards 80 (80*a*, 80*b*, 80*c*, and 80*d*) for pushing up the ribs 46 (46*a*, 46*b*, 46*c*, and 46*d*) provided for the developing apparatuses 4 (4*a*, 4*b*, 4*c*, and 4*d*) for respective colors that are yellow, magenta, cyan, and black. In this embodiment, a rack 91 (first switching means) is moved by rotation of drive means shown in FIG. 9, that is, a stepping motor 90 (to be described later), cams 93 rotate due to the movement of the rack 91, and the spacing boards 80 are vertically moved by the rotation of these cams 93. The positions, to which the spacing boards 80 move, are (1) a spaced position at which the spacing boards 80 are pushed up and the developing rollers 40 are spaced apart from the photosensitive drums 1 and (2) a developing position at which the pushing-up of the spacing boards 80 by the cams 93 is released and the developing rollers 40 are brought into contact with the photosensitive drums 1. With this construction, the pushing-up of the spacing board 80 is released only at the time of a developing operation, thereby moving the developing apparatuses 4 to a developing position, that is, a position at which the developing rollers 40 are abutted against the photosensitive drums 1.

The present invention is not limited to this, although when the pushing-up/releasing operation modes of the spacing boards 80 are limited, it becomes possible to realize a relatively simple structure. In this embodiment, it is possible to make a selection from among three states that are a standby state (see FIG. 1) in which the spacing boards 80 (80*a*, 80*b*, 80*c*, and 80*d*) for all of colors that are yellow, magenta, cyan, and black are pushed up and all of the developing rollers 40 are spaced from the photosensitive drums 1, a full-color state (see FIG. 7) in which the pushing-up of the spacing boards 80 (80*a*, 80*b*, 80*c*, and 80*d*) for all of the colors that are yellow, magenta, cyan, and black is released and all of the developing rollers 40 are abutted against the photosensitive drums 1, and a mono-color state (see FIG. 8) in which only the spacing boards 80 (80*a*, 80*b*, and 80*c*) for three colors that are yellow, magenta, and cyan are pushed up and only the developing roller 40 for black is abutted against its corresponding photosensitive drum 1.

Figure 9:
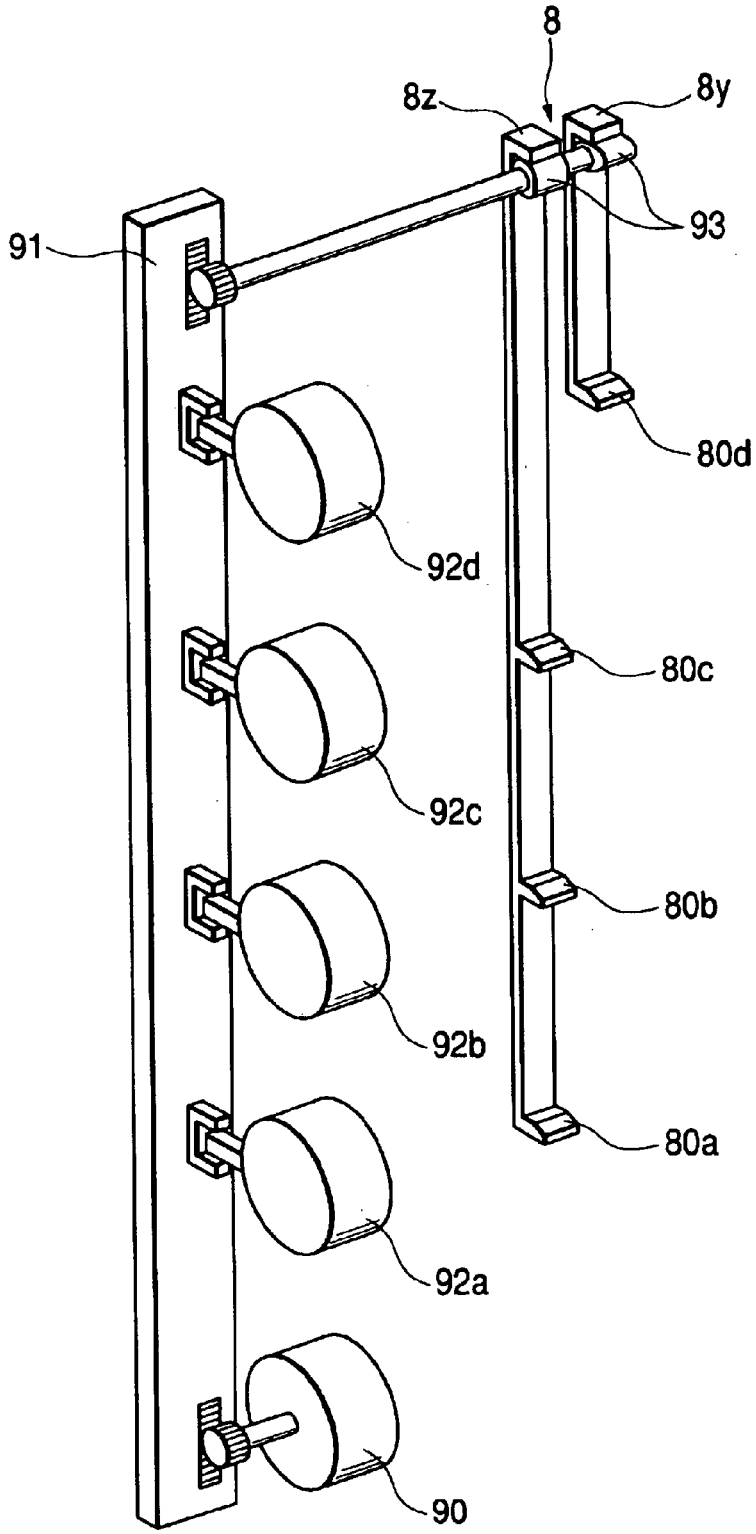
FIG. 9 is a perspective view showing an operation switching mechanism.

That is, in this embodiment, there are two kinds of space/contact switching means (second switching means) 8 that are space/contact switching means 8*y* for black, for which there has been formed a spacing board 80*d* for black, and a space/contact switching means 8*z* for color for which the spacing boards 80*a*, 80*b*, and 80*c* for yellow, magenta, and cyan have been integrated, as shown in FIG. 9. Also, by giving two kinds of profiles that respectively correspond to the space/contact switching means 8*y* and 8*z* to the cams 93 that move these space/contact switching means 8*y* and 8*z* for black and color, it becomes possible to perform switching between the modes described above.

Figure 10:
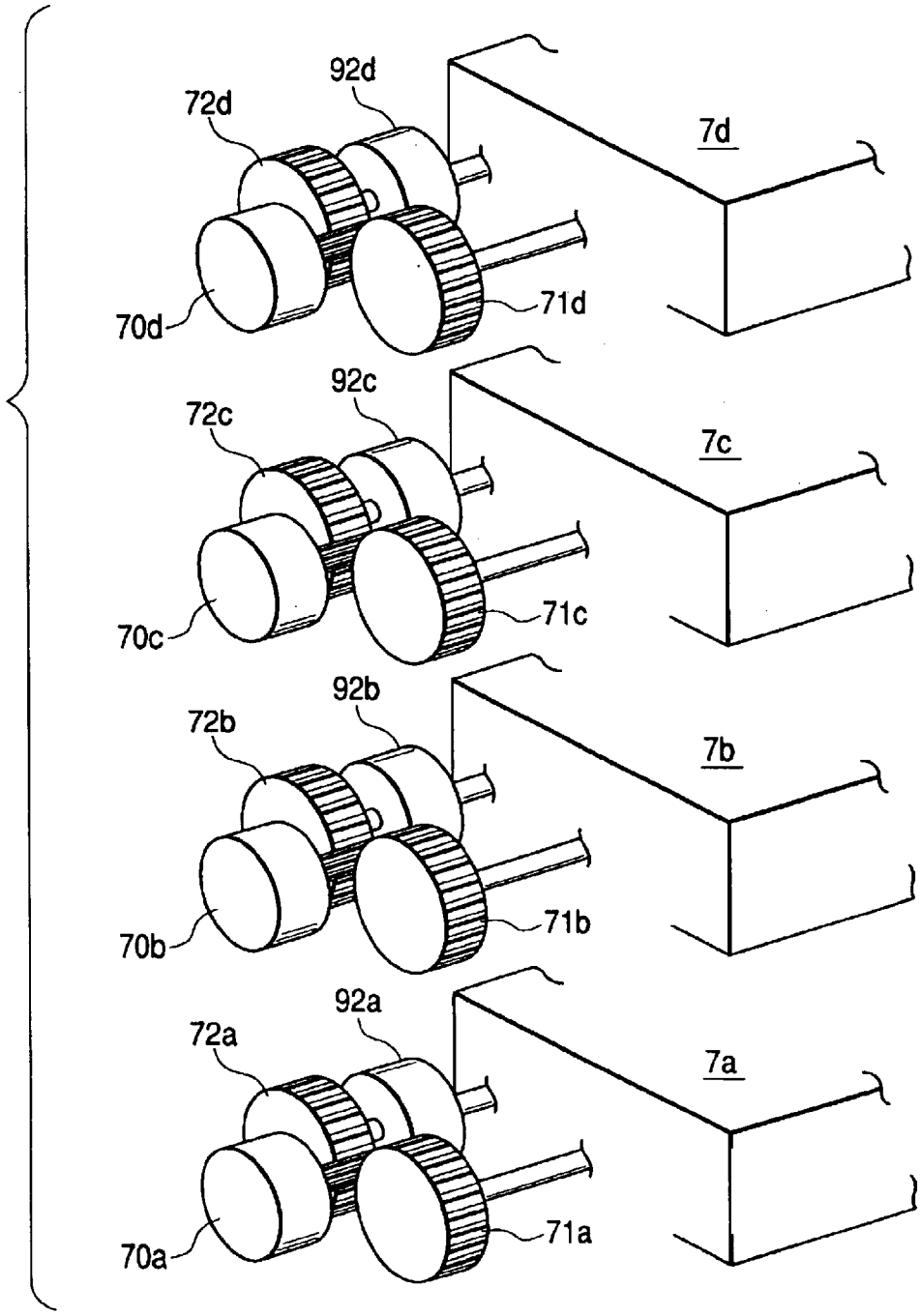
FIG. 10 is a perspective view of drive portions of the process cartridges.

In this embodiment, as shown in FIG. 10, from drive motors 70 (70*a*, 70*b*, 70*c*, and 70*d*) functioning as the drive means that are each provided for one color, the units that drive the process cartridges 7 branch to systems 71 (71*a*, 71*b*, 71*c*, and 71*d*) for driving the photosensitive drums 1 and systems 72 (72*a*, 72*b*, 72*c*, and 72*d*) for driving the developing rollers 40. Also, clutches 92 (92*a*, 92*b*, 92*c*, and 92*d*) functioning as drive switching means are provided on the drive side of the developing rollers 40, thereby making it possible to perform switching between rotation and stoppage of the developing roller 40 while the photosensitive drums 1 are rotating. As described above, in this embodiment, the photosensitive member drive means for driving the photosensitive drum 1 and the development drive means for driving the developing roller 40 in each process cartridge 7 is constructed from a common single motor. The drive force from the apparatus main assembly 110 side is transmitted to each of the photosensitive drums 1 and the developing rollers 40 by photosensitive member drive transmission means and development drive transmission means coupled to the drive unit on the apparatus main assembly 110 side under a state where the process cartridges 7 are attached to the apparatus main assembly 110.

With this drive construction, it becomes possible to control the driving of the photosensitive drums 1 for respective colors independently of each other. Therefore, it becomes possible to carry out control for reducing color drifts that always become a problem in an in-line type full-color image forming apparatus and to stop the driving of the developing rollers 40 under a state where the photosensitive drums 1 are driven. As a matter of course, the above construction, in which clutches 92 are provided, is realized at far low cost in comparison with a construction in which another motor is provided for each developing roller 40 in order to drive the developing roller 40.

In this embodiment, the clutches 92 perform the connection and cutting of a rotation force through the vertical movement of the rack 91 (first switching means). Under the standby state where the rack 91 is positioned at the center, all of the clutches 92 are disengaged and the developing rollers 40 do not make rotation. When the rack 91 is moved upward, the clutches 92 for all colors are engaged and the developing rollers 40 for all colors start rotation. When the rack 91 is moved downward, only the clutch 92 for black is engaged and the developing roller 40 for black starts rotation and other clutches 92 remain disengaged. That is, an operation to be performed is changed depending on whether mono-color image formation or full-color image formation should be performed.

The rotation of the cams 93 that move respective spacing boards 80 (second switching means) and the switching between engagement and disengagement of the clutches 92 in the drive systems for the developing rollers 40 are performed by vertically moving the first switching means 91 using the single stepping motor 90. In the standby state, all of the spacing boards 80 are lifted up (that is, all of the developing rollers 40 are spaced from the photosensitive members 1) and all of the clutches 92 are disengaged.

Figure 11:
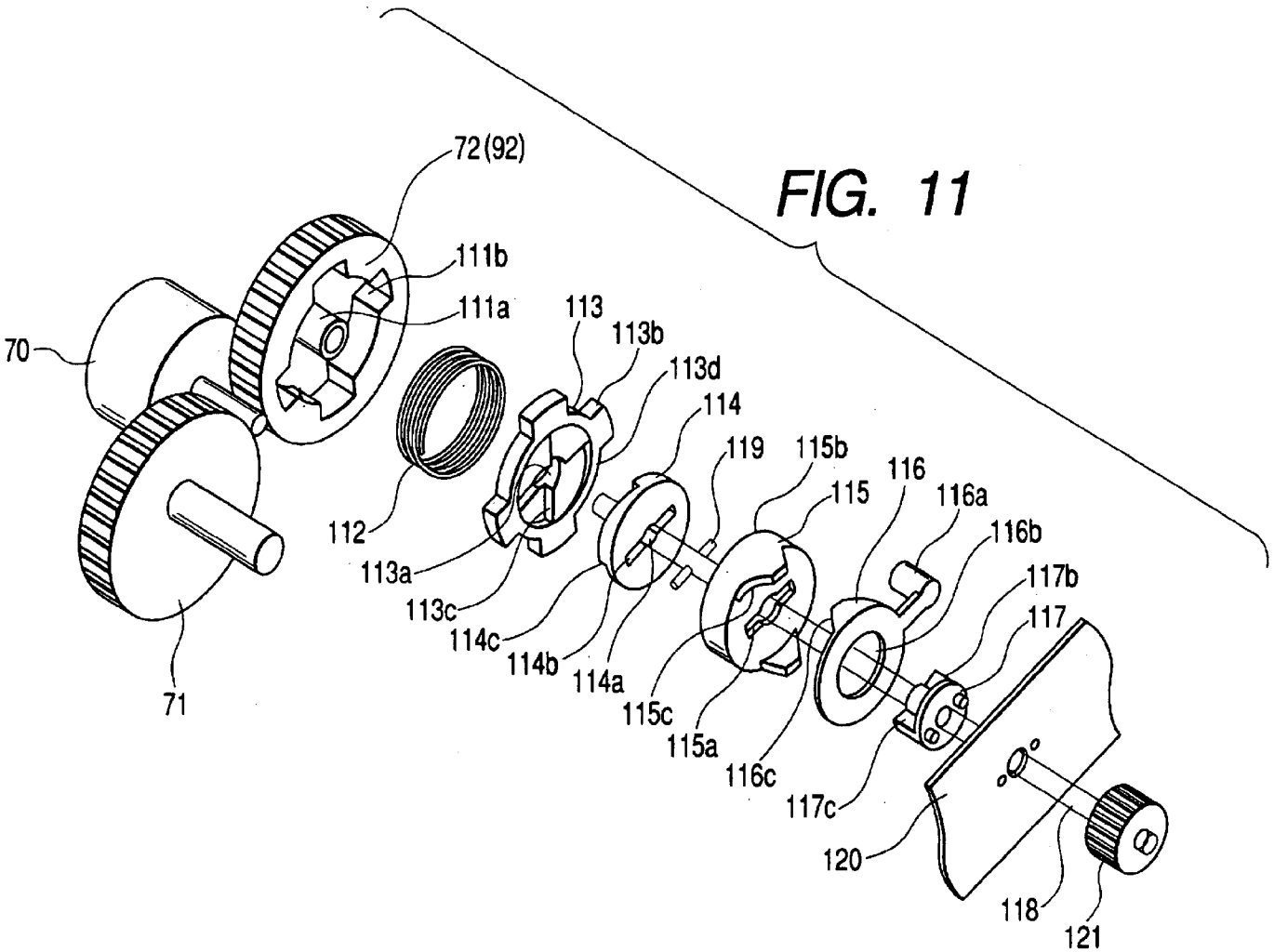
FIG. 11 is a perspective view showing a mechanical clutch.

Next, details of the clutches 92 (92*a*, 92*b*, 92*c*, and 92*d*) of the drive apparatuses will be described with reference to FIG. 11. Note that the clutch 92 and the system gear 72 are illustrated as different members in FIG. 10, although if these members are described in detail, the clutch 92 partially enters into the inside of the gear 72 and the gear 72 bears a part of the clutch function, as shown in FIG. 11.

The gear 72 functioning as a drive component that engages with the drive motor 70 is positioned by an unillustrated fixing member in an axial direction so as to be rotatable with reference to a rotation axis 118 on the driven side. The inside of the gear 72 is greatly lightened and the inner periphery of a slide boss 111*a* in proximity to the center becomes a positioning and sliding surface with reference to the rotation axis 118 on the driven side and the outer periphery thereof becomes a positioning and sliding surface for a drive side engagement component 113. In a like manner, in proximity to the outer periphery in the gear 72, four detents 111*b* are provided which function as detents for the drive side engagement component 113. The drive side engagement component 113 is slidably supported by fitting the outer peripheral portion of the slide boss 111*a* of the gear 72 into the inner peripheral surface 113*a*. At the same time, detents 113*b* provided for the outer peripheral portion are meshed with the detents 111*b* of the gear 72, so that the drive side engagement component 113 rotates in the same manner as the gear 72. On the other hand, the drive side engagement component 113 is provided with four protrusions 113*c* and, when these protrusions 113*c* are meshed with protrusions 114*c* of an driven side engagement component 114 on the driven side, it becomes possible to transmit a rotation force.

The drive transmission surfaces of the protrusions 113*c* are formed so as to be inclined in a direction in which the protrusions 113*c* are dug into a component on the opposite side through rotation. Thus, engagement is reliably established even if the clutch 92 is engaged during rotation and there is prevented tooth skipping even if a large torque is applied. Also, by connecting the drive transmission surfaces to each other using gently inclined surfaces, it becomes possible to smoothly establish engagement even if the clutches 92 are engaged during rotation.

The end surface on the driven side of the drive side engagement component 113 is provided with a releasing member 115 to be described later and a sliding portion 113*d* that is rotationally slid. Also, the drive side engagement component 113 is urged at all times toward the driven side engagement component 114 by a coil spring 112 functioning as an elastic member. Components contacting both ends of the coil spring 112 rotate in the same manner, so that there do not occur problems concerning the sliding of the end portions of the coil spring 112 and malfunctions ascribable to the changing of a winding diameter.

The driven side engagement component 114 is fixed through the fitting of the rotation axis 118 and a parallel pin 119 into an inner peripheral surface 114*a* and a groove 114*b*. Also, there exist the four protrusions 114*c* and, when these protrusions 114*c* are meshed with the protrusions 113*c* of the drive side engagement component 113 on the driven side, a rotation force is transmitted. The drive transmission surfaces of the protrusions 114*c* are inclined in a direction, in which these surfaces are dug like the protrusions 113*c* on the opposite side, and establish connection between the drive transmission surfaces using gently inclined surfaces. Also, the protrusions 113*c* are disposed point-symmetrically around a hole formed by the inner peripheral surface 113*a*. Further, the drive force transmission portions (in more detail, the tooth surface of the gear 72, the detents 111*b* and 113*b*, the protrusions 113*c* and 114*c*, the groove 114*b*, and the parallel pin 119) are disposed within approximately the same rotation plane. As described above, the protrusions 113*c* are disposed point-symmetrically and the drive force transmission portions are disposed within approximately the same rotation plane, so that it is possible to transmit a large load even with a small clutch.

The drive side engagement member 113, the driven side engagement member 114, and the coil spring 112 are contained inside of the gear 72. With this construction, it becomes possible to realize a compact construction through the effective use of a space. In addition, the drive force transmitted from the tooth surface of the gear 72 is transmitted to the inner side as it is. Therefore, there occurs no distortion force and tumbling force for the engagement components, it is easy to ensure strength of the components, and it becomes possible to transmit a large torque.

The rotation axis 118 is supported through a bearing member 117 so as to be freely rotated with reference to a frame 120 of the drive unit and transmits a rotation force from a gear 121 fixed at an end portion to the development drive portion of the process cartridge 7. The bearing member 117 is fixed to the frame 120 of the drive unit and its outer peripheral portion includes two sliding portions that are a sliding portion 117*c* having a detent and positioning function for the releasing member 115 and a cylindrical surface 117*b* on which a lever member 116 rotationally slides.

The lever member 116 is rotated through the fitting of the sliding portion 117*c* of the bearing member 117 in opening portion 116*b*, and its lever portion 116*a* is operated by the switching member (first switching means) 91 to be described later. The lever member 116 is provided with a cam portion 116*c* and is abutted against a cam portion 115*c* of the releasing member 115 to displace the position of the releasing member 115 in the axial direction. Also, a plurality of cam portions 115*c* and 116*c* are provided symmetrically with reference to a rotation center. With this construction, it becomes possible to prevent increase of malfunctions and an operation resistance due to the inclination of the releasing member 115.

The sliding portion 117*c* of the bearing member 117 is fitted into a sliding portion 115*a* inside of the releasing member 115. With this construction, the rotation of the releasing member 115 is regulated and the releasing member 115 is supported so as to be movable in the axial direction. The cam portion 115*c* has a shape corresponding to the cam portion 116*c* of the lever member 116 and is abutted against this cam portion 116*c*, thereby performing positioning in the axial direction. At the same time, a sliding portion 115*b* on a side opposite to the cam 93 is abutted against the drive side engagement component 113, thereby positioning the drive side engagement component 113 in the axial direction.

That is, under a state where the mountain of the cam portion 116*c* of the lever member 116 coincides with the mountain of the cam portion 115*c* of the releasing member 115, the releasing member 115 is pushed toward the gear 72. Therefore, the sliding portion 115*b* is abutted against the sliding portion 113*d* of the drive side engagement member 113 and pushes the drive side engagement member 113 apart from the driven side engagement member 114 in defiance of the energizing force of the coil spring 112. That is, there is obtained a state where the clutch 92 is disengaged.

If the drive motor 70 rotates under this state, although the sliding portion 113*d* slides on the sliding portion 115*b*, no load is placed on the driven side because the clutch 92 is disengaged. As a result, losses due to a sliding resistance do not cause any problem.

On the other hand, under a state where the mountain of the cam portion 116*c* of the lever member 116 coincides with the valley of the cam portion 115*c* of the releasing member 115 through the rotation of the lever member 116, the releasing member 115 is moved toward the gear 121 on the driven side by the energizing force of the coil spring 112 and the drive side engagement member 113 is pressed by an elastic force of the coil spring 112 and is meshed with the driven side engagement member 114. As a result, the clutch 92 is engaged and the rotation force is transmitted. A setting is made so that under a state where the engagement members are perfectly engaged with each other, gaps are generated between the drive side engagement member 113, the releasing member 115, and the lever member 116. As a result, almost no sliding load is placed on the sliding portions 113*d* and 115*b* and there occurs almost no reduction in efficiency.

It should be noted here that the construction of the clutch 92 described above may be changed to a construction where the drive side and the driven side are interchanged.

Figure 12A:
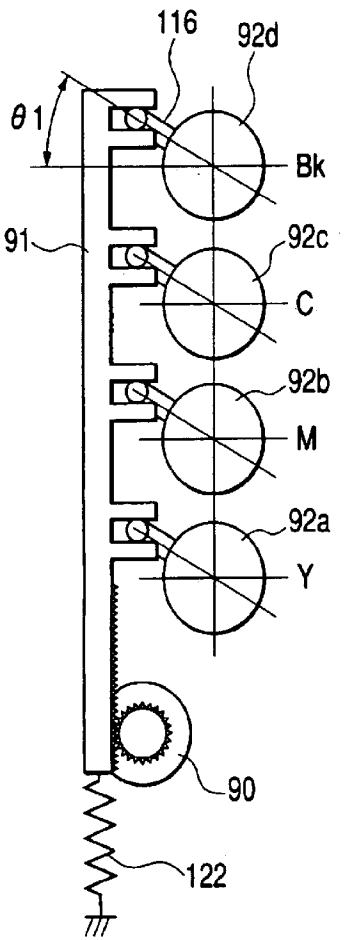
FIGS. 12A, 12B and 12C are each a schematic drawing showing a state of clutches at the time of full-color recording.
Figure 12B:
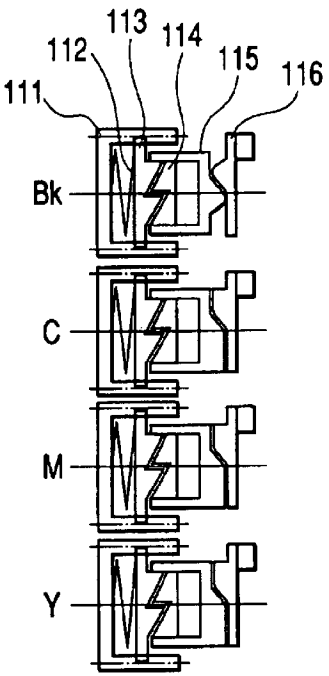
Figure 13A:
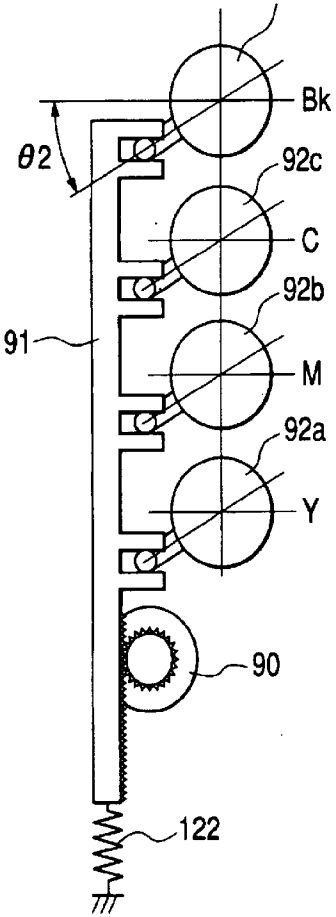
FIGS. 13A, 13B and 13C are each a schematic drawing showing a state of the clutches at the time of mono-color recording.
Figure 13B:
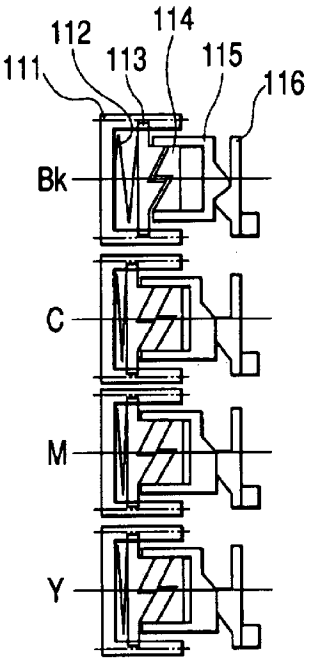

As shown in FIGS. 12B and 13B, the cam shapes of the lever member 116 and the releasing member 115 for black are different from those for other colors. That is, the cams for black have a mountainous shape, so that the vertexes of the mountains are abutted against each other and the clutch 92*d* is disengaged at a home position (position at which the angle θ of the lever member 116 is zero in FIG. 12A). When the lever member 116 is rotated in either of the upward direction and the downward direction from the home position, the clutch 92*d* is engaged. As to the cam shapes for other colors, one side thereof has an inclined surface like the cam shapes for black but the other side has a flat portion having the same height as the vertexes.

The clutches 92 for colors other than black are disengaged at the home position and are engaged if the lever members 116 are rotated from the home position in a direction (upward direction) in which the mountain and valley of the cams 93 are abutted against each other (see FIG. 12B). However, even if the lever member 116 is rotated toward an opposite side (downward direction), the clutches 92 remain disengaged (see FIG. 13B).

With this construction, it becomes possible to easily set a full-color print state, in which all of the clutches 92 are engaged, and a mono-color state, in which only the clutch 92*d* for black is engaged, with reference to the home position.

As shown in FIG. 9, it is possible to move the lever members 116 of the development drive clutches 92 and to rotate the cams 93 for moving the spacing boards 80 by vertically moving the switching member 91 using the single motor 90. The load resistance placed in order to operate the switching member 91 becomes the maximum when all of the four clutches 92 are disengaged after full-color printing is finished.

In contrast to this, if a spring 122 that pulls the switching member 91 in the downward direction is provided as shown in FIG. 12A, it becomes possible to pull down the switching member 91 moved to the top portion when full-color printing is finished with a strong spring force and to reduce a load placed at the time of disengagement the clutches 92 for all colors. This spring force also is effective for the reduction in a load placed when the spacing cams 93 are rotated and the developing rollers 40 for all colors are spaced when printing is finished.

On the other hand, when mono-color printing is finished, the spring force exerted on the switching member 91 moved to the lowest portion as shown in FIG. 13A is small, so that increase of a load placed at the time of the disengagement of the clutch 92*d* for black is minute. Further, through a spring setting with which the spring force becomes zero in proximity to the home position, it also becomes possible to make a setting that is effective for both of the case where the clutches 92 for all colors are to be disengaged and the case where only the clutch 92*d* for black is to be disengaged.

Also, as shown in FIG. 12B and other drawings, it becomes possible to evenly distribute the load by setting the inclined surfaces of the cams 93 used to disengage the clutches 92 for all colors as more gentle than the inclined surface used to disengage only the clutch 92*d* for black.

When the process cartridges 7 are attached to an apparatus main assembly 110, the developing drive and the spacing apparatus on the main assembly side are set at a home position and the switching member 91 is precisely positioned at a home position (position at which the angle θ1 FIG. 12A is zero) by an unillustrated sensor. At this time, the spacing boards 80 for all of the colors that are yellow, magenta, cyan, and black are placed in a pushed-up state, the ribs 46 provided for the developing apparatuses 4 ride on the spacing boards 80 along the insertion operation of the process cartridges 7, and the developing rollers 40 are placed in a state where the developing rollers 46 are spaced from the photosensitive drums 1 by a predetermined distance.

This spaced state is maintained at all times under a state where the power is turned off or development is not performed. Accordingly, even in the case where the printer remains unused for a long time under a state where the process cartridges 7 are attached to the printer, the developing rollers 40 are spaced from the photosensitive drums 1 at all times, which makes it possible to reliably prevent permanent deformation of roller layers caused by a situation where the developing rollers 40 contact the photosensitive drums 1 for a long time.

A recording operation for full-color printing and a recording operation for mono-color printing will be described separately.

In the case of full-color printing, when a recording operation is started in response to a print signal, all of the motors 70 for driving the process cartridges 7 and the drive motor for the transferring belt start rotation. At this time, the switching member 91 is placed at the home position and all of the clutches 92 are disengaged, so that none of the developing rollers 40 make rotation and all of the developing rollers 40 are spaced from the photosensitive drums 1.

Next, as shown in FIG. 12A, the stepping motor 90 rotates until a first stage in the clockwise direction in the drawing to lift up the switching member 91 to a first stage (first position). Therefore, the lever members 116 of all of the clutches 92 are rotated by the angle θ1 and all of the releasing members 115 and the drive side engagement members 113 are moved to the right side in the drawing and are engaged with the driven side engagement members 114, as shown in FIG. 12B. Therefore, the clutches 92 are engaged and all of the developing rollers 40 start rotation.

Here, in the case where the cartridge drive motors 70 make rotation after the stepping motor 90 rotates until the first stage, a shock load placed at the time of engagement of the clutches 92 is reduced. However, this is disadvantageous from the sake of shortening the rotation time of the developing rollers 40.

Figure 12C:
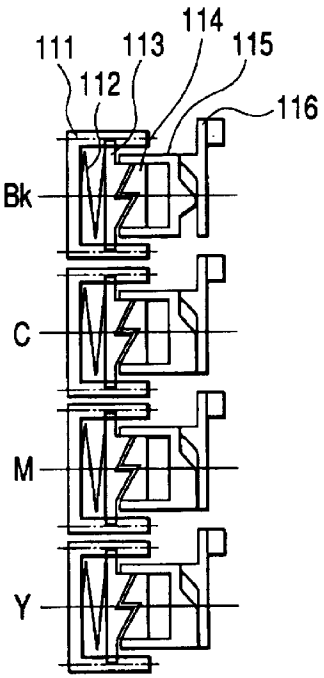

Next, when the stepping motor 90 rotates clockwise until a second stage, the switching member 91 is lifted up to a second stage (third position) and the lever members 116 are rotated by an angle θ3 (not shown). At this time, the releasing members 115 are placed at a position at which there is maintained the engagement between the drive side engagement components 113 and the driven side engagement components 114 (see FIG. 12C), so that all of the developing rollers 40 remain in a rotation state. On the other hand, the cams 93 for spacing are rotated and the pushing-up of the spacing boards 80 for color and black is released, so that all of the developing rollers 40 are brought into contact with the photosensitive drums 1 and are set in a recordable state.

After the recording is finished, the stepping motor 90 returns to the first stage, thereby spacing the developing rollers 40 from the photosensitive drums 1. Then, the stepping motor 90 rotates and returns to its initial state, thereby disengaging all of the clutches 92. As a result, the rotation of the developing rollers 40 is stopped and the cartridge drive motors 70 and the transferring belt drive roller 13 are stopped. Note that the rotation for returning the stepping motor 90 from the first stage to the initial state may be performed after the cartridge drive motors 70 and the transferring belt drive roller 13 are stopped.

As described above, in the case of full-color printing, first, the switching member 91 is moved from the home position to the first position (angle of the lever member 116 is θ1), thereby setting all of the clutches 92 in the engaged state. Thereafter, the switching member 91 is moved to the third position (angle of the lever member 116 is θ3), thereby having all of the developing rollers 40 abutted against the photosensitive drums 1. As a result of these operations, the developing rollers 40 are abutted against rotating photosensitive drums 1 under a state where the developing rollers 40 are rotating. As a result, it becomes possible to suppress a shock caused at the time of the abutment.

In the case of mono-color printing, when a recording operation is started in response to a print signal, like in the case of the full-color printing, all of the motors 70 for driving the process cartridges 7 and the motor for driving the transferring belt start rotation. At this time, all of the clutches 92 are disengaged, so that the developing rollers 40 do not make rotation.

Next, as shown in FIG. 13A, when the stepping motor 90 rotates until the first stage in the counterclockwise direction in the drawing and the switching member 91 is lowered until a first stage (second position) in the downward direction, the lever members 116 of all of the clutches 92 rotate by an angle θ2. Therefore, as shown in FIG. 13B, only the clutch 92*d* for black is engaged and other clutches 92*a* to 92*c* remain disengaged, so that only the developing roller 40 for black starts rotation.

Here, in the case where the stepping motor 90 is rotated until the first stage and then the cartridge drive motors 70 are rotated, a shock load placed at the time of engagement of the clutches 92 is reduced. However, this is disadvantageous for the sake of shortening the rotation time of the developing rollers 40.

Figure 13C:
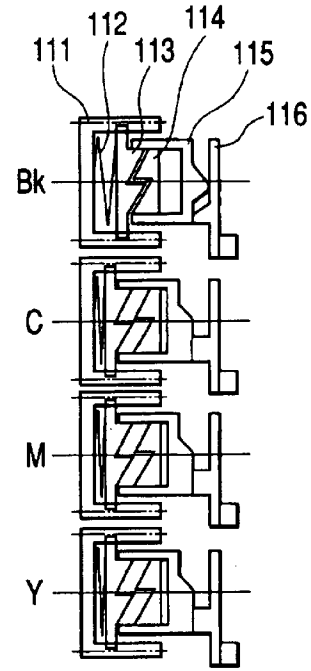

Next, when the stepping motor 90 rotates in the counterclockwise direction until a second stage, the switching member 91 is lowered until a second stage (fourth position) in the downward direction and the lever members 116 are rotated by an angle θ4 (not shown). At this time, as shown in FIG. 13C, there is maintained a state where the releasing member 115 for black is positioned at the first stage, so that the developing roller 40 for black remains in a rotation state. On the other hand, the cams 93 for spacing are rotated and the pushing-up of only the spacing board 80*d* for black is released and the developing roller 40 for black is brought into contact with the photosensitive drum 1 and is set in a recordable state.

After the recording is finished, the stepping motor 90 returns to the first stage, thereby spaxing the developing roller 40 from the photosensitive drum 1. Then, the stepping motor 90 rotates and returns to its initial state, thereby stopping the rotation of the developing roller 40 and stopping the cartridge drive motors 70 and the transferring belt drive roller 13. Note that the rotation for returning the stepping motor 90 from the first stage to the initial state may be performed after the cartridge drive motors 70 and the transferring belt drive roller 13 are stopped.

As described above, in the case of mono-color printing, first, the switching member 91 is moved from the home position to the second position (angle of the lever member 116 is θ2), thereby setting only the clutch 92*d* for black in the engaged state. Thereafter, the switching member 91 is moved to the fourth position (angle of the lever member 116 is θ4), thereby having only the developing roller 40 for black abutted against the photosensitive drum 1. As a result of these operations, like in the case of the full-color printing, the developing roller 40 is abutted against the rotating photosensitive drums 1 under a state where the developing roller 40 is rotating. As a result, it becomes possible to suppress a shock caused at the time of the abutment. Also, in the case of the mono-color printing, like in the case of the full-color printing, all of the photosensitive drums 1 are rotated, so that it becomes possible to minimize the wear and tear due to rubbing with the transferring belt 11.

In the course of image forming performed in this manner, prior to the formation of electrostatic latent images by the scanner units 3, pre-rotation is performed in order to give uniform electric charges to the peripheral surfaces of the photosensitive drums 1. Then, after toner images are developed, there is carried out a process, such as post-rotation, for diselectrifying the potential of the peripheral surfaces of the photosensitive drums 1. At the time of the pre-rotation and the post-rotation, the developing rollers 40 are spaced from the photosensitive drums 1, so that the wasting of toner due to fog or the like is avoided and it becomes possible to lessen the shaving of surface layers due to rubbing between the photosensitive drums 1 and the developing rollers 40.

Also, by integrating modes so that it is possible to make selection from among three states that are the standby state (see FIG. 1) in which the spacing boards 80 for all of the colors are pushed up, the full-color state (see FIG. 7) in which the pushing-up of the spacing boards 80 for all of the colors is released, and the mono-color state (see FIG. 8) in which only the spacing boards 80 for three colors that are yellow, magenta, and cyan are pushed up. Therefore, it becomes possible to simplify component constructions and control.

Also, the switching member 91 is given an elastic force by the spring 122 so as to be energized in a direction in which the plurality of clutches 92 are disengaged, which makes it possible to reduce an operation torque and to realize cost reduction of electronic components, such as a motor, and mechanical components.

It should be noted here that in each embodiment described above, explanation has been made by assuming that the image forming apparatus 100 is an image forming apparatus that forms a recording image by successively transferring toner images from the plurality of photosensitive drums 1 onto the transferring material S transported by the transferring belt 11. However, the present invention is not limited to this and is, for instance, equally applicable to an image forming apparatus that adopts a so-called intermediate transfer system that is known by persons skilled in the art. With this system, toner images in a plurality of image forming portions that each include a photosensitive drum and processing means, such as charging means, developing means, and cleaning means, that act on the photosensitive drum are successively superimposed and transferred onto an intermediate transferring belt functioning as an intermediate transferring body that orbitally moves while opposing respective image forming portions. Then, the toner images are secondary-transferred onto a transferring material transported by a separately provided transferring material transporting system by one operation, thereby obtaining a recording image. Even in this case, it is possible to obtain the same effects as above. The intermediate transferring member constitutes an image transporting member that transports the toner images transferred from respective photosensitive drums.

In such an image forming apparatus, it is possible to control driving of the photosensitive drums, the developing rollers, and the intermediate transferring belt and to control spacing/contact of the developing rollers with respect to the photosensitive drums in the same manner as the embodiment described above except that the transferring belt is replaced with the intermediate transferring belt. Here, all of the description in the above embodiment is applied to this case by replacing the term "transferring belt" in the description with the term "intermediate transferring belt".

The present invention is not limited to the examples described above and includes various modifications within the technical idea of the present invention.

What is claimed is:

1. An image forming apparatus comprising:

a plurality of image forming portions, each image forming portion including an image bearing member, developing means that is capable of contacting and being spaced from the image bearing member and supplies developer to the image bearing member, a motor that drives the developing means, and clutch means that is provided between the motor and the developing means;

a first switching means for acting on the plurality of clutch means; and a second switching means for having the developing means contact and spaced from the image bearing member, the second switching means communicating with the first switching means and operating in association with an operation of the first switching means.

2. An image forming apparatus according to claim 1, wherein one of the plurality of image forming portions is used to form a black image, wherein the clutch means of the black image forming portion differs from the clutch means of the image forming portions for other colors, wherein, in the case that the first switching means is set at a first position, the clutch means of all of the image forming portions are set in a drive transmission state, and wherein, in the case that the first switching means is set at a second position, the clutch means of the black image forming portion is set in the drive transmission state and the clutch means of the image forming portions for other colors are set in a non-drive transmission state.

3. An image forming apparatus according to claim 2, wherein, in the case that the first switching means further moves from the first position to a third position, the second switching means moves and the developing means of all of the image forming portions are abutted against the image bearing members, and wherein, in the case that the first switching means further moves from the second position to a fourth position, a part of the second switching means moves and only the developing means of the black image forming portion is abutted against the image bearing member.

4. An image forming apparatus according to claim 3, wherein the second switching means is divided into two members that are a switching member for the black image forming portion and a switching member for the image forming portions for other colors.

5. An image forming apparatus according to claim 1, wherein the motor also drives the image bearing member.

6. An image forming apparatus according to claim 1, wherein the image bearing member and the developing means are detachably attachable to a main assembly of the image forming apparatus as a unit.

7. An image forming apparatus comprising:

a first image forming portion for forming a black image, the first image forming portion including a first image bearing member and a first developing means that is capable of contacting and being spaced from the first image bearing member and supplies developer to the first image bearing member;

second image forming portions for forming images in colors other than black, each of the second image forming portions including a second image bearing member and a second developing means that is capable of contacting and being spaced from the second image bearing member and supplies developer to the second image bearing member; and switching means for switching contact/space operations of the first developing means and the second developing means, the switching means being capable of moving the first developing means and the second developing means to a full-color image forming state in which the first developing means and the second developing means are respectively abutted against the first image bearing member and the second image bearing members, a mono-color image forming state in which only the first developing means is abutted against the first image bearing member, and a standby state in which all of the developing means are spaced from the image bearing members.

8. An image forming apparatus according to claim 7, wherein the first image bearing member and the first developing means are detachably attachable to a main assembly of the image forming apparatus as a first unit, and wherein the second image bearing member and the second developing means of each second image forming portion are detachably attachable to the main assembly of the image forming apparatus as a second unit.

* * * * *